US009145594B2

(12) United States Patent
Toji et al.

(10) Patent No.: US 9,145,594 B2
(45) Date of Patent: Sep. 29, 2015

(54) METHOD FOR MANUFACTURING ULTRA HIGH STRENGTH MEMBER

(75) Inventors: Yuki Toji, Tokyo (JP); Kohei Hasegawa, Tokyo (JP)

(73) Assignee: JFE Steel Corporation (JP)

( * ) Notice: Subject to any disclaimer, the term of this patent is extended or adjusted under 35 U.S.C. 154(b) by 366 days.

(21) Appl. No.: 13/636,484

(22) PCT Filed: Feb. 18, 2011

(86) PCT No.: PCT/JP2011/000925

§ 371 (c)(1),
(2), (4) Date: Nov. 26, 2012

(87) PCT Pub. No.: WO2011/118126

PCT Pub. Date: Sep. 29, 2011

(65) Prior Publication Data

US 2013/0199679 A1 Aug. 8, 2013

(30) Foreign Application Priority Data

Mar. 24, 2010 (JP) ..... 2010-068325
Mar. 24, 2010 (JP) ..... 2010-068326

(51) Int. Cl.

| | |
|---|---|
| ***C21D 8/00*** | (2006.01) |
| ***B21D 22/02*** | (2006.01) |
| ***B21D 24/16*** | (2006.01) |

(Continued)

(52) U.S. Cl.

CPC ..... *C21D 8/005* (2013.01); *B21D 22/02* (2013.01); *B21D 22/022* (2013.01); *B21D 24/16* (2013.01); *B21D 28/243* (2013.01); *B21D 35/001* (2013.01); *B21D 37/16* (2013.01); *C21D 1/18* (2013.01); *C21D 1/673* (2013.01); *C21D 8/04* (2013.01); *C21D 9/0062* (2013.01); *C21D 9/0068* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C25D 5/36* (2013.01); *C21D 8/0426* (2013.01); *C21D 8/0436* (2013.01);

(Continued)

(58) Field of Classification Search
None
See application file for complete search history.

(56) References Cited

FOREIGN PATENT DOCUMENTS

| | | |
|---|---|---|
| EP | 1 195 208 | 4/2002 |
| EP | 2 324 938 | 5/2011 |

(Continued)

OTHER PUBLICATIONS

Machine-English translation of Japanese patent No. 2009-197253, titled "Method for Producing Hot-Pressed Member," Nishihata Toshinobu, Sep. 3, 2009.*

(Continued)

*Primary Examiner* — Deborah Yee
(74) *Attorney, Agent, or Firm* — DLA Piper LLP (US)

(57) ABSTRACT

A method for manufacturing an ultra high strength member includes heating a steel sheet at a first heating temperature within a temperature range of 700 to 1000° C.; forming the steel sheet into a shape of a member at the first heating temperature and simultaneously cooling the steel sheet; after completion of the cooling, shear punching the steel sheet into a desired shape to obtain an ultra high strength member; and after the shear punching, subjecting the ultra high strength member to a first heat treatment including heating the ultra high strength member at second heating temperature within a temperature range of 100° C. or higher, but lower than 300° C. and retaining the member at the second heating temperature for 1 second to 60 minutes, wherein the resulting ultra high strength member has a tensile strength of 1180 MPa or more.

2 Claims, 4 Drawing Sheets

(51) Int. Cl.

| | |
|---|---|
| ***B21D 28/24*** | (2006.01) |
| ***B21D 37/16*** | (2006.01) |
| ***C21D 1/18*** | (2006.01) |
| ***C21D 1/673*** | (2006.01) |
| ***C21D 8/04*** | (2006.01) |
| ***C21D 9/00*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C25D 5/36*** | (2006.01) |
| ***B21D 35/00*** | (2006.01) |

(52) U.S. Cl.
CPC ... *C21D 2211/001* (2013.01); *C21D 2211/005* (2013.01); *C21D 2211/008* (2013.01)

(56) References Cited

FOREIGN PATENT DOCUMENTS

| | | | |
|---|---|---|---|
| GB | 1490535 | A | 11/1977 |
| JP | 3406094 | | 5/2003 |
| JP | 2006-104527 | A | 4/2006 |
| JP | 2006-110713 | A | 4/2006 |
| JP | 2006-111966 | A | 4/2006 |
| JP | 2008-081788 | A | 4/2008 |
| JP | 2008-119702 | | 5/2008 |
| JP | 2008-284610 | A | 11/2008 |
| JP | 4288201 | B2 | 7/2009 |
| JP | 2009-197253 | A | 9/2009 |
| JP | 2010-144229 | A | 7/2010 |
| JP | 2010-163684 | A | 7/2010 |
| WO | 2005/009642 | | 2/2005 |
| WO | 2010/029983 | | 3/2010 |

OTHER PUBLICATIONS

The Official Action issued by the Chinese Patent Office on Sep. 3, 2013 in corresponding Chinese Application No. 201180015613.7 along with the English translation.

"Delayed Fracture," *Nikkan Kogyo Shimbun Ltd.*, Aug. 31, 1989 (1 sheet partial English translation).

*International Journal of Automotive Engineering*, Sep. 2008, vol. 39, No. 5, p. 133-138 (2 sheets of partial English translation).

*Press Technology*, Aug. 2008, vol. 42, No. 8, pp. 38-42 (2 sheets of partial English translation).

Takagi, S. et al., "Evaluation of Hydrogen Embattlement for High Strength Steel Sheets with Ammonium Thiocyanate Solution (NH4SCN)," *CAMP-ISIJ* (*Current Advances in Materials and Processes—Iron and Steel Institute Japan*), 2008, vol. 21, p. 1454 (2 sheets of English translation).

Supplementary European Search Report dated Jul. 1, 2015 of corresponding European Application No. 11758938.2.

Taiwanese Office Action dated Jul. 30, 2015 of corresponding Taiwanese Application No. 100106231 along with its English translation.

* cited by examiner

METHOD FOR MANUFACTURING ULTRA HIGH STRENGTH MEMBER

RELATED APPLICATIONS

This is a §371 of International Application Not PCT/JP2011/000925, with an international filing date of Feb. 18, 2011 (WO 2011/118126 A1, published Sep. 29, 2011, which is based on Japanese Patent Application No. 2010-068325 filed Mar. 24, 2010 and Japanese Patent Application No. 2010-068326 filed Mar. 24, 2010, the subject matter of which is incorporated herein by reference.

TECHNICAL FIELD

This disclosure relates to a method for manufacturing an ultra high strength member excellent in delayed fracture resistance that is suitable for automobile framework members, reinforcing members, and so on, as well as a method for using the ultra high strength member.

BACKGROUND

Recently, from the viewpoint of global environment protection, there is an increasing demand for improved fuel efficiency in automobiles. Further, from the viewpoint of protecting occupants in vehicle collisions, there is another increasing demand for improved safety of automobile bodies. As such, to satisfy the needs for both improved fuel efficiency and enhanced safety, many considerations have been given toward the possibilities of achieving both reducing weight and reinforcing automobile bodies.

Stronger and thinner component materials are effective to satisfy both reducing weight and reinforcing automobile bodies. Lately, ultra high strength members using high tensile steel sheets having a tensile strength TS of 1180 MPa or more are beginning to be used as automobile framework members, reinforcing members, and so on.

However, as described in *"Delayed Fracture,"* Nikkan Kogyo Shimbun Ltd., Aug. 31, 1989, high strength steel sheets having TS of 1180 MPa or more are more likely susceptible to delayed fracture during use due to penetration of hydrogen associated with corrosion, as compared to other steel sheets having, lower strength. This limits application of such high strength steel sheets having TS of 1180 MPa or more.

Further, members such as automobile framework members are generally put into use after being subjected to forming such as press forming and roll forming. However, it is known that delayed fracture resistance of these members tends to deteriorate due to such forming process, as described in *International Journal of Automotive Engineering*, Vol. 39, No. 5, p. 133. Thus, there are demands for an ultra high strength member that is excellent in delayed fracture resistance after forming process.

On the other hand, when TS is equal to or higher than 1180 MPa, formability itself degrades.

Moreover, members such as automobile framework members are usually put into use after being subjected to first forming and then chemical conversion treatment and electrodeposition coating. Delayed fracture may occur due to penetration of hydrogen during chemical conversion treatment and electrodeposition coating in such cases. Although delayed fracture is less likely to occur during chemical conversion treatment and electrodeposition than in a corrosion environment in actual use, there is a possibility that delayed fracture may occur during chemical conversion treatment and electrodeposition coating, which are supposed to be milder than a corrosion environment in actual use, when strength of the member is increased to 1320 MPa or more in particular. Thus, it is necessary to prevent delayed fracture from occurring during the conversion treatment or electrodeposition coating after forming.

For example, known as one of the methods to solve this problem is a technique where a steel sheet is formed, while the steel sheet is hot and strength thereof is lowered, and simultaneously cooled in a die, so that a high component strength is obtained (this technique will be referred to as a "hot pressing process" hereinafter), as disclosed in *Press Technology*, Vol. 42, No. 8. p. 38 and UK 1490535. This hot pressing process is known to offer better delayed fracture resistance to workpieces than working at room temperature does because in the former: (1) no strain due to working remains, (2) residual stress due to working is small, and so on (see *Press Technology*, Vol. 42, No. 8, p. 38).

However, when automobile components are manufactured by the hot pressing process, some working steps are required, such as circumference trimming of components by punching and shearing for the purposes of shaping components after working, or perforation by punching which is necessitated by assembling purposes (these steps will be collectively referred to as "punching"). Such punching after the hot pressing process introduces a large strain and residual stress to the steel sheet, thereby significantly increasing the risk of delayed fracture during use. To solve this problem, the following two methods have been primarily considered:

(a) reducing the amount of hydrogen penetrating into a steel sheet during heating at the time of hot pressing; and (b) reducing residual stress by punching after hot pressing.

Regarding (a) above, for example, JP-A 2006-104527, JP-A 2006-110713, JP-A 2006-111966 and JP-A 2008-284610 disclose techniques for reducing the amount of hydrogen penetrating into steel during heating by controlling the atmosphere in a heating furnace. Further, JP-B 4288201 discloses a technique for improving the resistance to delayed fracture susceptibility by heat treatment at 150 to 700° C. following hot pressing to release the hydrogen which has penetrated into a steel sheet during hot pressing.

Regarding (b) above, JR-A 2006-104527 discloses a technique for reducing the residual stress due to punching by reducing the cooling rate after hot pressing of a portion to be punched and thereby reducing the strength due to the resulting insufficient quenching.

Further, JP-A 2006-110713 discloses a technique for improving delayed fracture resistance by using a laser or plasma to melt, cut and remove any portion where the residual stress generated by punching remains.

JP-A 2006-111966 discloses a technique for improving delayed fracture resistance by removing any portion where the residual stress generated by punching remains by machining or the like.

JP-A 2008-284610 discloses a technique for improving delayed fracture resistance by precisely controlling the clearance of punching after hot pressing to reduce the ratio of shear droop length to sheet thickness.

Further, JP-A 2009-197253 discloses a technique for improving the resistance to delayed fracture susceptibility by performing heat treatment at 300° C. or higher but not higher than 400° C. for 10 minutes or less after punching and thereby reducing the tensile residual stress residing in a processed edge.

SUMMARY

However, even if the amount of penetrating hydrogen during heating is reduced by controlling, e.g., the atmosphere in the heating furnace prior to hot pressing as described in JP-A 2006-04527, JP-A 2006-110713, JP-A 2006-111966 and JP-A 2008-284610, or alternatively, if dehydrogenation treatment is carried out after of pressing as is the case with JP-B 4288201, it is not possible to lower the risk of delayed fracture due to the hydrogen penetrating into the steel sheet in association with corrosion during use, conversion treatment and electrodeposition coating. Further, JP-B 4288201 does not refer to the degradation in delayed fracture resistance due to a strain and residual stress introduced by punching after hot pressing.

On the other hand, as regards a method for reducing the residual stress due to punching after hot pressing, the method of JP-A 2006-104527 complicates the die structure for reducing the cooling rate only at a portion for punching and thus requires excessive facility cost. Further, it is difficult to manage the cooling rate at a portion for punching according to the method of JP-A 2006-104527. In short, it is difficult to obtain an effect of reducing residual stress in a stable manner in the method of JP-A 2006-104527.

Further, the methods of JP-A 2006-110713 and JP-A 2006-111966 involve laser processing and machining after punching, which leads to poor productivity and increased cost. As is the case with JP-A 2008-284610, in a method for precisely controlling punching clearance, clearance management is difficult and so it is considered infeasible to apply the method to such mass production as is done in manufacturing automobile components. The method of JP-A 2009-197253 requires heating at a relatively high temperature of 300° C. or higher for reducing the residual stress after punching. Thus, the high strength martensite generated by hot pressing will be tempered, which results in a lower strength. Consequently, a larger amount of alloy elements is required to obtain a desired strength, which is economically disadvantageous.

Currently, as described above, laser process ng is predominantly used for circumference trimming and drilling after hot pressing, which has caused an increase in cost of components.

Therefore, it could be helpful to provide a method for manufacturing an ultra high strength member having a tensile strength TS of 1180 MPa or more, so that an ultra high strength member excellent in delayed fracture resistance can be manufactured by the hot pressing process at low cost, and a method for using the same.

SUMMARY

We provide a method for manufacturing an ultra high strength member, the method comprising: heating a steel sheet at first heating temperature within a temperature range of 700 to 1000° C.; forming the steel sheet into a shape of a member at the first heating temperature and simultaneously cooling the steel sheet; and, after completion of the cooling, shear punching the steel sheet into a desired shape to obtain an ultra high strength member, characterized in that the method further comprises: after the shear punching, subjecting the ultra high strength member to first heat treatment including heating the ultra high strength member at second heating temperature within a temperature range of 100° C. or higher but lower than 300° C. and retaining the member at the second heating temperature for 1 second to 60 minutes, wherein the resulting ultra high strength member has a tensile strength of 1180 MPa or more.

In the above-described method for manufacturing an ultra high strength member, an ultra high strength member having a tensile strength of 1320 MPa or more in particular is likely to experience delayed fracture during chemical conversion treatment or electrodeposition coating when the member is used with coating formed thereon after punching. Thus, when manufacturing an ultra high strength member having a tensile strength of 1320 MPa or more, it is preferable that the ultra high strength member is subjected to the first heat treatment prior to coating.

Further, the first heat treatment is preferably carried out so that the second heating temperature is 200° C. or more and a retention time at the second heating temperature is preferably 10 minutes or less. Moreover, it is preferable that after being subjected to the first heat treatment, the ultra high strength member is further subjected to second heat treatment whereby the ultra high strength member is heated at a third heating temperature within a temperature range of 150° C. or more but less than 300° C. and held at the third heating temperature for 1 second to 10 minutes.

We also provide a method for using an ultra high strength member obtained by: heating a steel sheet at first heating temperature within a temperature range of 700 to 1000° C.; forming the steel sheet into a shape of a member at the first heating temperature and simultaneously cooling the steel sheet; and, after completion of the cooling, shear punching the steel sheet into a desired shape to obtain an ultra high strength member, the method comprising: before using the ultra high strength member, subjecting the ultra high strength member to first heating treatment including heating the ultra high strength member at second heating temperature within a temperature range of 100° C. or higher but lower than 300° C. and retaining the member at the second heating temperature for 1 second to 60 minutes, wherein the resulting ultra high strength member has a tensile strength of 1180 MPa or more.

The method comprises: heating a steel sheet at a first heating temperature within a temperature range of 700 to 1000° C.; molding the steel sheet into a shape of a component at the first heating temperature and at the same time starting to cool the steel sheet; and after completion of the cooling, forming the steel sheet into a desired shape by shear punching to obtain an ultra high strength member, wherein after the shear punching, the ultra high strength member is subjected to first heat treatment whereby the ultra high strength member is heated at a second heating temperature within a temperature range of 100° C. or more but less than 300° C. and held at the second heating temperature for 1 second to 60 minutes. This may suppress penetration of hydrogen and allow for production of an ultra high strength member having a tensile strength of 1180 MPa or more and excellent in delayed fracture resistance at low cost.

Further, in the above-described method for manufacturing an ultra high strength member, when an ultra high strength member, particularly, having a tensile strength of 1320 MPa or more, is used with coating after punching, delayed fracture may occur during conversion treatment or electrodeposition coating. However, by applying the first heat treatment prior to coating, it is possible to manufacture an ultra high strength member excellent in delayed fracture resistance and having a tensile strength of 1320 MPa or more at low cost.

Since the ultra high strength member thus obtained has both high strength and delayed fracture resistance, it is suitable for structural materials, such as automobile framework members and reinforcing members.

REFERENCE NUMERALS

1: Steel sheet
2: Coil
WK: Workpiece
TW: Ultra high strength member

DETAILED DESCRIPTION

Examples of methods will be described with reference to the attached drawings hereinafter.

First Example

A first example will be described.

[Production Method]

Figure 1:
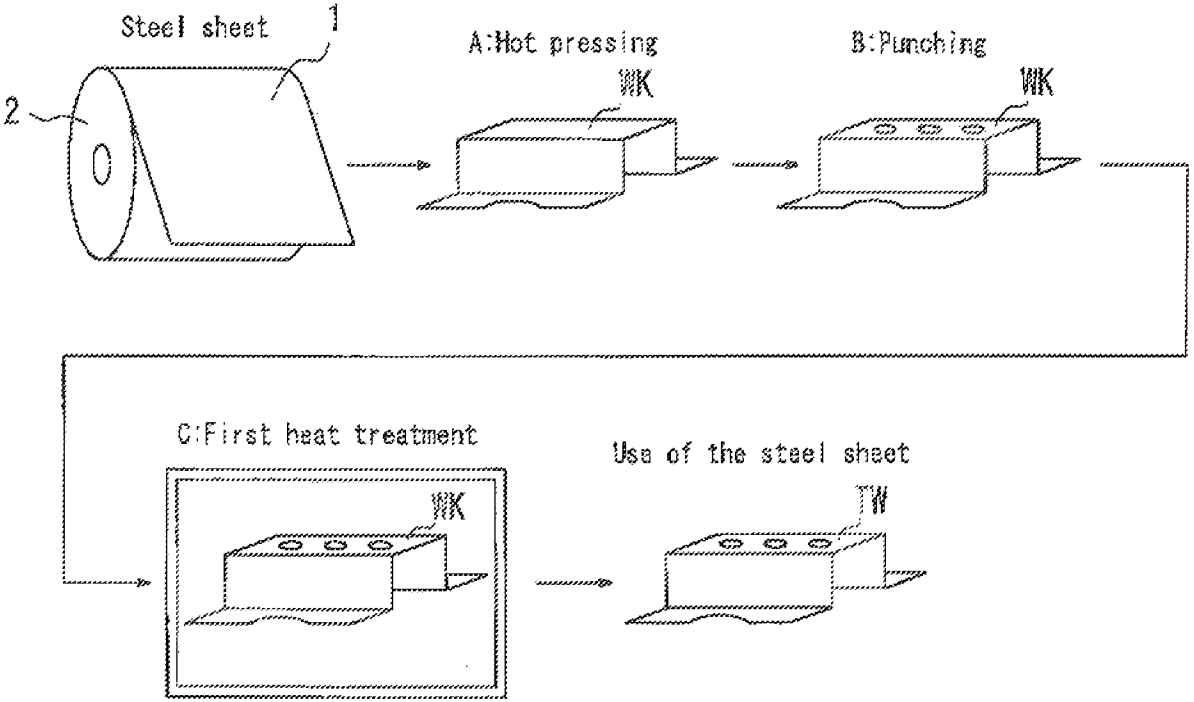
FIG. 1 is conceptual diagram illustrating a method for manufacturing an ultra high strength member according to a first example.

FIG. 1 is conceptual diagram illustrating a method for manufacturing an ultra high strength member according to a first example. In FIG. 1, reference numeral 1 denotes a steel sheet as a base material and reference numeral 2 indicates a coil which is obtained by rolling up the steel sheet 1. This steel sheet will be discussed later.

In the method for manufacturing an ultra high strength member according to this example, as shown in FIG. 1, a hot press forming step A, a punching step B and a first heat treatment step C are performed in the stated order to obtain an intended ultra high strength member TW.

In the above-described hot press forming step A, a sheet of the steel sheet 1 having a predetermined length is cut out from the coil 2 of the steel sheet 1 (a feeder and shears are not shown), and a workpiece WK made up of the cut sheet of the steel sheet/is subjected to hot press forming (hot pressing process) and thereby formed into a shape of a component for use.

The first heating temperature at the time of hot press forming is to be within a temperature range of 700 to 1000° C. If the first heating temperature is below 700° C., austenite is hardly generated during heating. As a result, martensite necessitated for achieving an increased strength is hardly formed when the steel sheet is hot pressed and simultaneously cooled with a die in cooling process, whereby strength of the steel sheet rather decreases lower than that before the hot press forming due to coarsening of carbides and coarsening of ferrite particle size during heating. In a case where the first heating temperature is above 1000° C., austenite grains are coarsened and therefore toughness degradation and increase in scale loss become significant. As such, the first heating temperature is to be within a temperature range of 700 to 1000° C. More preferably, from the viewpoint of suppressing coarsening of austenite particle and scale loss, the first heating temperature is to be within a temperature range of 900° C. or less. The higher first heating temperature results in the higher strength of the workpiece obtained after cooling with a die when the first heating temperature is within a temperature range of 700 to 900° C. Therefore, heating temperature may be selected according to the desired strength and type of the material.

The retention time at the first heating temperature is preferably 5 minutes or less to prevent a situation where the cost for heating increases, and, front the viewpoint of homogenizing the microstructure prior to quenching process to ensure stable product characteristics, the retention time at the first heating temperature is preferably 1 minute or more.

The steel sheet heated and retained at the first heating temperature is subjected to hot press forming and at the same time cooled with a die. At this moment, from the viewpoint of obtaining desired strength in a stable manner, an average cooling rate is preferably 25° C./sec or more, more preferably 30° C./sec or more. Similarly, in terms of stabilization of strength, a finish cooling temperature is preferably 150° C. or less, more preferably 100° C. or less.

In the punching step B, the hot press forming is followed by, e.g., circumference trimming and drilling by shear punching. This shear punching may be conducted according to a conventional method without limitation.

It should be noted that coating may be performed by applying chemical conversion treatment and then electrodeposition coating to the workpiece WK that is formed into the desired shape of a component in the hot pressing step A and punching step B. This conversion treatment/electrodeposition coating may also be conducted according to a conventional method without limitation.

In the first heat treatment step C, the workpiece WK, which has been previously subjected to shear punching, and possibly additional conversion treatment/electrodeposition coating, is subjected to first heat treatment whereby the workpiece WK is heated at a second heating temperature within a temperature range of 100° C. or more but less than 300° C. and held at the second heating temperature for 1 second to 60 minutes.

In the first heat treatment step C, the workpiece WK, which has been previously subjected to shear punching, is subjected to first heat treatment whereby the workpiece WK is heated at a second heating temperature within a temperature range of 100° C. or more but less than 300° C. and held at the second heating temperature for 1 second to 60 minutes.

Through the aforementioned series of steps, an ultra high strength member TW which has been formed into the desired shape is manufactured and subjected to use.

[First Heat Treatment Step]

Among the above-described steps, the first heat treatment step C is characteristically important in this example and so will be discussed in more detail below.

(Background and Effects of the First Heat Treatment Step)

Firstly, the background and effects of the first heat treatment step C will be described. Different steel sheets were manufactured such that each contained in mass %: C: 0.10 to 0.40%; Si: 0.01 to 3.0%; and Mn: 0.5 to 3.0% to investigate the delayed fracture resistance of the following: (i) members that were each formed into a predetermined shape of a component by the hot pressing step; (ii) members that were each further subjected to circumference punching and trimming or perforation by punching; and (iii) members that were each further subjected to first heat treatment at a second heating temperature of 100° C. or more but less than 300° C., after the punching.

Figure 2:
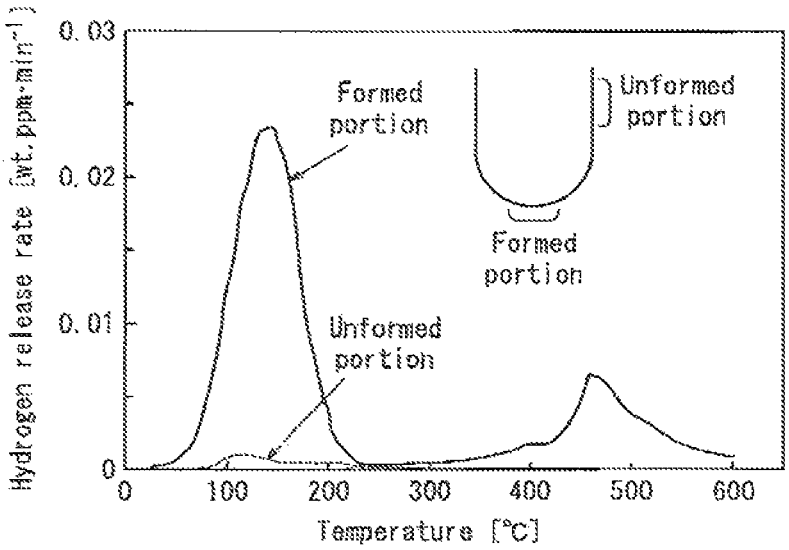
FIG. 2 illustrates a relationship between temperature and hydrogen release rate of a formed portion and a relationship between temperature and hydrogen release rate of an unformed portion, respectively.

As a result of comparing (i) with (ii), when performing punching as stated in (ii), a deterioration in delayed fracture resistance was observed at edges of the members, as has been previously reported. The present inventors believed that this deterioration is ascribed to an increase in the amount of penetrating hydrogen at the punched edges, which increase is due to large strain introduced by punching as described in *International Journal of Automotive Engineering*, Vol. 39, No. 5, p, 133, as well as residual stress caused by punching, working strain caused by punching and damage such as microvoids, as well as. An example of experimental results corroborating this fact is shown in FIG. 2. FIG. 2 shows relationships between temperature and hydrogen release rate of formed and unformed portions, respectively, of a test specimen prepared by immersing a steel sheet bent in a shape in hydrochloric acid of pH 1 for 48 hours to introduce hydrogen into the steel. It can be seen from the results shown in FIG. 2 that more hydrogen is released from the formed portion than from the unformed portion. We believe that this is because defects introduced by forming such as dislocations serve as trap sites of hydrogen.

Figure 3:
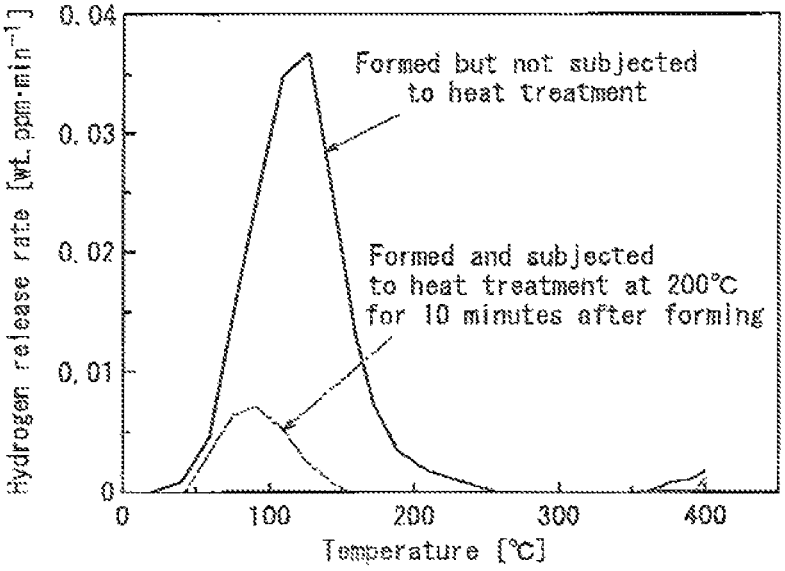
FIG. 3 illustrates a relationship between temperature and hydrogen release rate of a member punched but not subjected to heat treatment after punching and a relationship between temperature and hydrogen release rate of another member punched and subjected to heat treatment at 200° C. for 10 minutes after punching.

In contrast, the members of (iii), which were further subjected to the first heat treatment at the second heating temperature of 100° C. or more but less titan 300° C. after the punching, showed significantly improved delayed fracture resistance as compared to the members of (ii). We believe that this improvement is ascribed to a decrease in the amount of penetrating hydrogen, which decrease occurs because solute C and solute N are fixedly attached by heat treatment to defects such as dislocations which would otherwise serve as trap sites of hydrogen and increase the amount of penetrating hydrogen. An example of experiment results supporting this assumption is shown in FIG. 3. FIG. 3 illustrates a relationship between temperature and hydrogen release rate of a member formed (punched) but not subjected to heat treatment after punching and a relationship between temperature and hydrogen release rate of another member formed (punched) and subjected to heat treatment at 200° C. for 10 minutes after punching, wherein each of the members had been charged with hydrogen by immersion in hydrochloric acid of pH 1 for 48 hours. It can be seen from the results shown in FIG. 3 that the amount of penetrating hydrogen, which has increased due to the previous forming process, is reduced greatly through heat treatment at 200° C.

We found from this result that a workpiece WK formed in the punching step B can be made less susceptible to delayed fracture by being further subjected to the first heat treatment step C.

(Conditions in the First Heat Treatment Step)

Conditions in the first heat treatment step C will be described next.

Second Heating Temperature in the First Heat Treatment:

The second heating temperature in the first heat treatment step C is to be 100° C. or more but less than 300° C. if the second heating temperature is below 100° C., it takes a relatively long time (more than 60 minutes) to complete the heat treatment which reliably suppresses penetration of hydrogen, which deteriorates productivity of members. Thus, the second heating temperature is to be 100° C. or more, preferably 150° C. or more, more preferably 200° C. or more. The higher second heating temperature results in the shorter time to complete the heat treatment required to suppress hydrogen penetration. Particularly, if the second heating temperature is 200° C. or more, retention time at the second heating temperature may be shortened to about 10 minutes or less, so that a sufficient effect can be obtained by heat treatment over a relatively short period of time. However, since the high strength member manufactured by the hot pressing step has microstructure mainly constituted of martensite, the member suffers from significant softening due to tempering of martensite at the second heating temperature of 300° C. or more. Thus, the second heating temperature is to be less than 300° C., more preferably 250° C. or less.

Retention Time at the Second Heating Temperature:

The retention time at the second heating temperature in the first heat treatment step C is to be 1 second to 60 minutes. If the retention time is less than 1 second, a sufficient effect of suppressing hydrogen penetration cannot be obtained. It is thus preferable that the retention time is 30 seconds or more from the viewpoint of obtaining a sufficient effect of suppressing hydrogen penetration. The higher second heating temperature allows the shorter retention time thereat. However, if the retention time at the second heating temperature is over 60 minutes, productivity is impaired. Thus, the retention time at the second heating temperature is 60 minutes or less, more preferably 30 minutes or less.

Second Example

A second example will be described next.

[Production Method]

Figure 4:
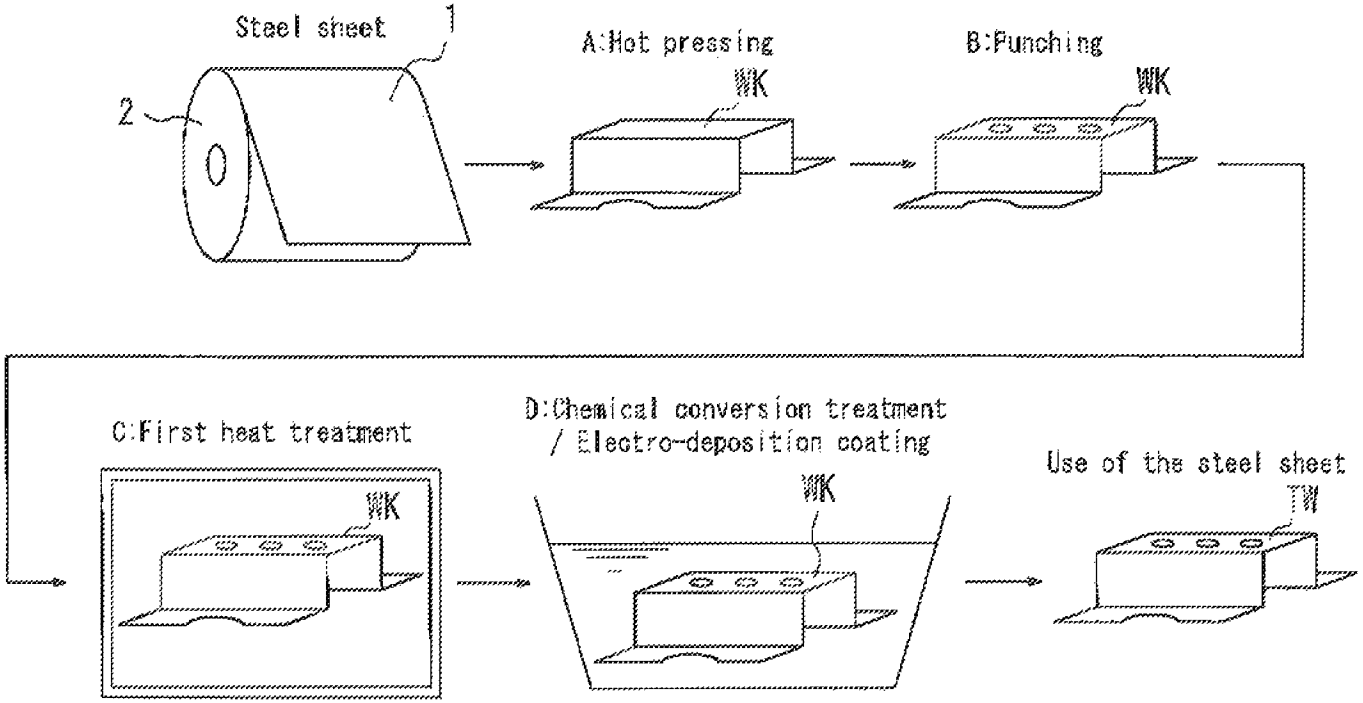
FIG. 4 is a conceptual diagram illustrating a method for manufacturing an ultra high strength member according to a second example.

FIG. 4 is a conceptual diagram illustrating a method for manufacturing an ultra high strength member according to a second example. It should be noted that in FIG. 4, the same reference numerals represent the same components and method steps as those illustrated in FIG. 1 of the first example.

The method for manufacturing an ultra high strength member according to the second example involves, as illustrated in FIG. 4, the hot press forming step A, punching step B and first heat treatment step C corresponding to the first example, additionally followed by a conversion treatment/electrodeposition coating step D. Accordingly, the hot press forming step A, punching step 13 and first heat treatment step C are the same as those stated in the first example and so explanations thereof will be omitted.

The conversion treatment/electrodeposition coating step D involves coating by conversion treatment and then electrodeposition coating, of the workpiece. WK which has been formed into the target shape in the hot pressing step A, punching step B and heat treatment step C. This step may be conducted according to a conventional method without limitation.

Through the aforementioned series of steps A-D, an ultra high strength member TW which is formed into the desired shape and coated is manufactured and subjected to use.

[Steel Sheet]

The steel sheet 1 as the material on which this example is based is acceptable as long as the steel sheet (ultra high strength member) obtained as the final product has a tensile strength of 1180 MPa or more, more preferably 1320 MPa or more. An exemplary composition of the steel sheet 1 and an exemplary method for manufacturing the same will be described below. However, the composition of the steel as the material and the method for manufacturing the steel sheet are not restricted to these examples.

(Exemplary Composition of the Steel Sheet)

To ensure a tensile strength of 1180 MPa or more of the steel sheet obtained as the final product (the ultra high strength member). C content in steel is preferably 0.1 mass % or more. To ensure a tensile strength of 1320 MPa or more of the steel sheet (the ultra high strength member) obtained as the final product, C content in steel is preferably 0.14 mass % or more. However, if C content in steel exceeds 0.5 mass %, toughness of the steel sheet deteriorates. It is thus preferable that the upper limit of C content in steel is 0.5 mass % or less.

Depending on the application of the steel sheet, other chemical compositions may be contained in the steel sheet within preferred content ranges shown below.

Si: 3.0 mass % or less; Mn: 0.5 to 1.0 mass %; P; 0.1 mass % or less; S: 0.01 mass % or less; Al: 0.01 to 0.1 mass %; N: 0.02 mass % or less: Ti: 0.1 mass % or less; Nb: 0.1 mass % or less; V: 0.5 mass % or less; Mo: 0.5 mass %; Cr: 1 mass % or less; B: 0.005 mass % or less; Cu: 0.05% mass % or less; and Ni: 0.5 mass % or less. The balance is composed of Fe and incidental impurities. Examples of the incidental impurities include Sb, Sn, Zn, Co, and so on. Acceptable content ranges of these incidental impurities are, Sb: 0.01 mass % or less; Sn: 0.1 mass % or less; Zn: 0.01 mass % or less; and Co: 0.1 mass or less, respectively. Further, inclusion of Mg, Ca, Zr and REM in the steel composition within normal ranges (as impurities) generally observed in standard steel composition does not adversely affect the effect of improving delayed fracture resistance by heat treatment.

(Exemplary Method for Manufacturing the Steel Sheet)

An exemplary method for manufacturing the steel sheet 1 as the material will be described below. However, the method for manufacturing the steel sheet 1 is not so limited. For example, the steel sheet 1 may preferably be manufactured by continuous casting or ingot casting of molten steel, of which chemical compositions have been adjusted to the above-described ranges, to obtain a slab, and subjecting the slab to a hot rolling step, cold rolling step and continuous annealing step in this order. While a steel slab for use in the present invention is preferably manufactured by continuous casting from the viewpoint of preventing macrosegregation of components, the steel slab may also be manufactured by ingot casting or thin slab casting.

Next, the hot rolling step will be described. The hot rolling step may be carried out by either a conventional method where a slab is cast, once cooled to the room temperature and then heated again or an energy-saving process such as direct rolling and hot direct rolling, without causing any problems, where a hot slab is directly charged into a heating furnace without cooling, or a hot slab is kept hot for while and then immediately rolled, or a hot slab is directly rolled after casting.

If a slab is cooled to the room temperature and then heated again, it is preferable that the slab is heated at a slab heating temperature of 1000° C. or more. Although there is no particular upper limit, it is preferable that the slab is heated at a slab heating temperature of 1300° C. or less because there is an increase in scale loss associated with an increased oxidation weight, and so on, over 1300° C. Further, if a hot slab is directly charged into a heating furnace without cooling, it is also preferable that the slab is heated at a slab heating temperature of 1000° C. or more.

Then, after being optionally subjected to rough rolling, the slab is preferably subjected to finish rolling at a finish rolling temperature of 800° C. or more. If the finish rolling temperature is below 800° C., the structure of the steel sheet becomes less uniform, which may deteriorate formability. Although there is no particular upper limit, it is preferable that the finish rolling temperature is 1000° C. or less because rolling at an excessively high temperature causes scale defects.

The steel sheet is coiled up after the hot rolling, preferably at a temperature of 700° C. or less. If the coiling temperature exceeds 700° C., a large amount of scales is generated after the coiling, which increases the load of pickling prior to cold rolling.

Next, the cold rolling step will be described. In the cold rolling step, the hot-rolled steel sheet is subjected to cold rolling to obtain a cold-rolled steel sheet. Any cold rolling conditions may be used without any particular limitation as long as the conditions allow a cold-rolled steel sheet to be formed into a desired dimensional shape. Rolling reduction rate is at least 20% from the viewpoint of surface flatness and microstructural uniformity. Pickling may be performed according to a conventional method before cold rolling. Alternatively, the hot rolled steel sheet thus coiled may be directly subjected to cold rolling in a case where scales formed on surfaces thereof are very thin.

Then, the resultant cold-rolled steel sheet is subject to annealing to obtain a cold-rolled annealed steel sheet. Preferably, annealing is continuous annealing using a continuous annealing line. In annealing, the cold-rolled steel sheet is preferably heated and retaining at a temperature range of 700° C. or more but less than 900° C. If the heating and retention temperature is less than 700° C., sufficient recrystallization does not take place, which may deteriorate the formability. On the other hand, when the heating and retention temperature exceeds 900° C., the microstructure coarsens and balance between strength and formability of the steel sheet deteriorates. Further, from the viewpoint of productivity, the heating and retention time is preferably 600 seconds or less. Further, from the viewpoint of uniformity in properties of the steel sheet, the heating and retention time is preferably 60 seconds or more, more preferably 120 seconds or more. The relatively low average cooling rate after annealing is preferable because the softer steel sheet is the more advantageous in terms of blanking and so on before hot pressing, although the average cooling rate is not particularly restricted. However, the average cooling rate of 1° C./s or more is preferred because too low average cooling rate after annealing adversely affects the productivity. Further, the steel sheet is preferably retained at 100 to 450° C. right after being cooled to the temperature range or after once being cooled to the room temperature, for retention time preferably in the range of 3 to 30 minutes.

It should be noted that the steel sheet as the material is not limited to the cold rolled steel sheet, hut may be applied to every steel sheet, such as a hot-dip galvanized steel sheet, electrolytic zinc coated steel sheet and hot-rolled steel sheet, where a steel sheet obtained as the final product (an ultra high strength member) therefrom should have TS of 1180 MPa or more or 1320 MPa or more. Further, the steel sheet may also be used in a non-annealed state following the cold rolling. Further, the effects of the present invention are also successfully obtained regardless of surface modification treatment such as providing a steel sheet surface with Ni or the like for improving corrosion resistance, or the like. Yet further, after the production of the steel sheet, the steel sheet may be subjected to temper rolling at an elongation rate of 5% or less for the purposes of shape correction, adjustment of surface roughness, and so on.

Modified Examples and Other Applications (1) In the first example, an example has been described where the steel sheet 1 is formed into the desired shape of a member and then subjected to shear punching, followed by optional coating, after which the steel sheet 1 is subjected to first heat treatment whereby the steel sheet is heated at a second heating temperature within a temperature range of 100° C. or more but less than 300° C. and retained at the second heating temperature for 1 second to 60 minutes, to obtain a ready-for-use finished member TW. However, the present invention is not so limited. Rather, an ultra high strength member TW as a finished product, which has been manufactured with or without the aforementioned first heat treatment, may be subjected prior to use thereof to a first heat treatment whereby the steel sheet is heated at a second heating temperature within a temperature range of 100° C. or more but less than 300° C. and retained at the second heating temperature for 1 second to 60 minutes. It is possible to modify the finished ultra high strength member TW to have excellent delayed fracture resistance and use the modified member in this case, as well.

For example, if the ultra high strength member TW is used for a structural member of an automobile, it is subjected to the first heat treatment in advance under the above-mentioned heat treatment conditions before it is assembled into the automobile as a frame or the like. It should be noted that the timing of applying the first heat treatment to an ultra high strength member does not need to be immediately before using the ultra high strength member TW and may be at any point in a period between the completion of production of the ultra high strength member TW and actual use of the ultra high strength member TW.

(2) The ultra high strength member TW, which is obtained in the above-mentioned first and second embodiments, is preferably used for structural materials in general, not limited to automobile use but rather preferably applied in other fields where high intensity and good delayed fracture resistance are required, such as in household appliances and construction equipment.

(3) In the first example, an example is shown where the first heat treatment is applied to the entire workpiece WK after coating; in the second example, another example is described where the first heat treatment is applied to the entire workpiece WK before coating. However, as illustrated in FIG. 2, a sufficient effect can be obtained by applying the first heat treatment to at least those portions subjected to punching. Accordingly, in a case where punching is not complicated, it suffices that the first heat treatment is applied to only punched portions to obtain the good effect of the first heat treatment.

Third Example

Next, a third example will be described.

[Production Method]

Figure 5:
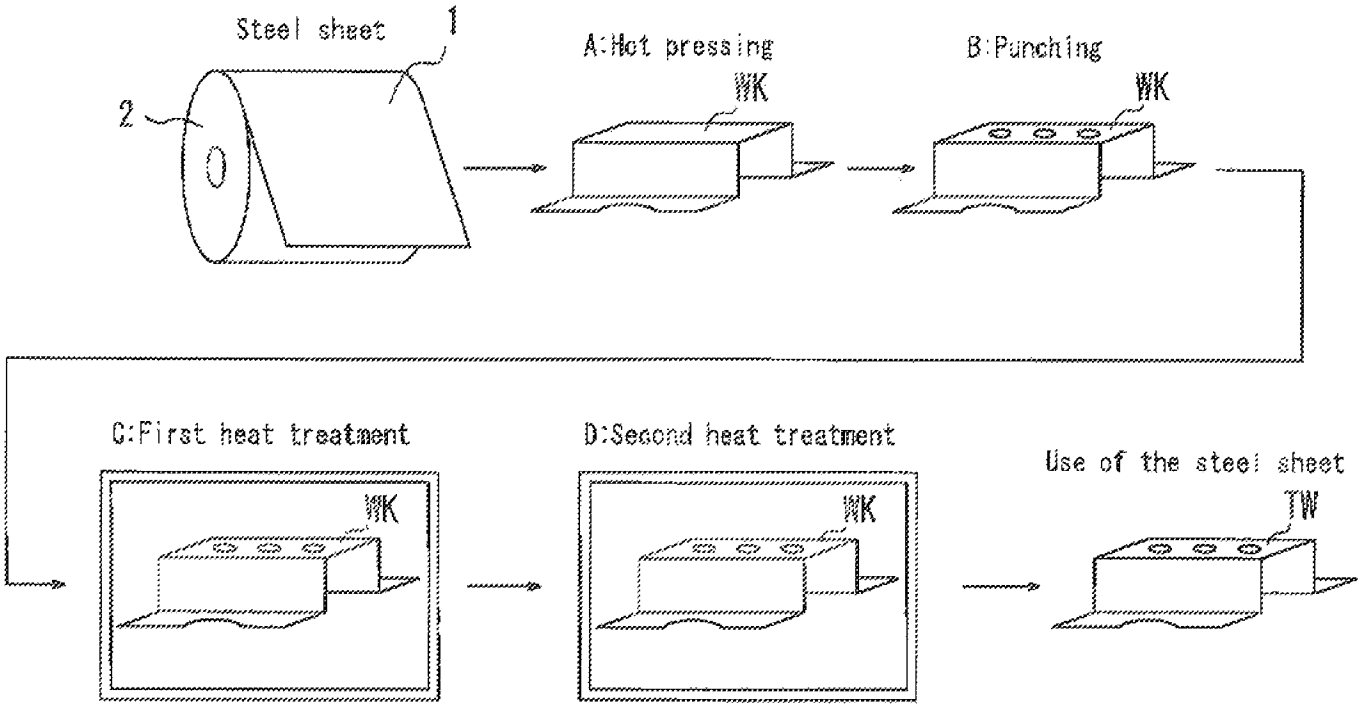
FIG. 5 is a conceptual diagram illustrating a method for manufacturing an ultra high strength member according to a third example.

FIG. 5 is a conceptual diagram illustrating a method for manufacturing an ultra high strength member according to a third example. It should be noted that in FIG. 5, the same reference numerals represent the same components and method steps as those illustrated in FIG. 1 of the first example.

A method for manufacturing an ultra high strength member according to the third example is the same as that of the first example regarding the steps A to C but different in that the former involves second heat treatment step D for reheating after the first heat treatment step C, as illustrated in FIG. 5.

In the second heat treatment step D, the workpiece WK, which has been subjected to heat treatment in the first heat treatment step C, is subjected to a second heat treatment whereby the workpiece is heated at third heating temperature within a temperature range of 150° C. or more but less than 300° C. and retained at the third heating temperature for 1 second to 10 minutes.

The other production steps, the steel sheet 1 as the product and so on are the same as those stated in the first embodiment and so explanations thereof will be omitted.

[Second Heat Treatment Step]

The second heat treatment step D, which is a characteristic feature of the third embodiment, will be described in detail below.

(Effect of the Second Heat Treatment Step)

In the third example, the second heat treating of reheating the workpiece at a third heating temperature within a temperature range of 150° C. or more but less than 300° C. is carried out after the first heat treatment step C and the subsequent cooling, whereby an ultra high strength member TW having both high strength and delayed fracture resistance is obtained. This additional second heat treatment step D allows desired delayed fracture resistance to be achieved in a shorter time, as compared to only using the first heat treatment step C. While the reasons for this are not entirely clear, the inventors of the present invention believe that the second heat treatment causes such a good effect as described above because solute C and solute N, which have been fixed during the first heat treatment to dislocations introduced by forming, are more firmly fixed to these dislocations due to reheating for a short time during the second heat treatment, thereby suppressing penetration of hydrogen.

Other effects in the third example are the same as those described in the first embodiment.

(Conditions in the Second Heat Treatment Step)

Conditions of the second heat treatment step D will be described below.

Third Heating Temperature in the Second Heat Treatment:

A third heating temperature in the second heat treatment step D is to be within a temperature range of 150° C. or more but less than 300° C. To obtain an effect of more firmly fixing solute C and solute N, which have been fixed during the first heat treatment to dislocations introduced by forming, to these dislocations through reheating for a short time during the second heat treatment to well suppress penetration of hydrogen, it is preferable that the third heating temperature in the second heat treatment is 150° C. or more, although specific third heating temperature is to be set depending on the conditions of the first heat treatment. If the third heating temperature is below 150° C., a long heat treatment time (retention time) over 10 minutes is required, which adversely affects productivity. Preferably, the third heating temperature is 200° C. or more. However, if the third heating temperature is 300° C. or more, strength of the steel sheet 1 may decrease depending on the type of the steel sheet 1. Accordingly, the third heating temperature is less than 300° C., preferably 250° C. or less.

The retention time at the third heating temperature in the second heat treatment step D is to be in the range of 1 second to 10 minutes. If the retention time at the third heating temperature is below 1 second, this may not offer a sufficient effect of suppressing penetration of hydrogen. It is preferable that the retention time at the third heating temperature is 30 seconds or more from the viewpoint of obtaining a sufficient effect of suppressing penetration of hydrogen. However, considering that the present embodiment involves two heating treatments, i.e. the first and second heat treatment steps, retention time at the third heating temperature in the second heating treatment exceeding 10 minutes may adversely affect productivity. The retention time at the third heating temperature is therefore to be 10 minutes or less, preferably 5 minutes or less.

EXAMPLES

Experiment 1

Steel slab samples having the chemical compositions shown in Table 1 were manufactured by continuous casting, reheated to 1250° C. and then hot rolled at a finish rolling temperature of about 850° C. to hot rolled steel sheet samples each having thickness of 3.0 mm. Each of the hot rolled sheet samples was subjected to coiling at coiling temperature of about 600° C., pickling, and cold rolling to be finished to a cold rolled steel sheet having a sheet thickness of 1.6 mm.

Then, the cold rolled steel sheet was heated and soaked at 800° C. for 300 seconds, cooled to 400° C. at the average cooling rate of 5° C./sec, and then subjected to overaging treatment at 400° C. for 10 minutes. Subsequently, the steel sheet was subjected to temper rolling at an elongation rate of 0.2%.

Each of the steel sheet samples thus obtained were cut to a test piece having dimension of 50 mm W×200 mm L such that the longitudinal axis of the piece was perpendicular to the rolling direction. The test piece was heated to 900° C., collected after 3 minutes and then immediately cooled by bringing upper and lower steel dies into close contact with the test pieces, which simulated cooling of a steel sheet at the hot press forming step. The cooling rate at this stage was about 50° C./sec and the finish cooling temperature was 100° C. or less.

The resulting test piece were further subjected to the corresponding heat treatment(s) shown in Table 2 and analyzed for tensile strength TS and delayed fracture resistance thereof. The details of each test method are as follows.

Tensile Strength TS

A JIS No. 5 tensile test specimen was taken from each of the test pieces of the steel sheet samples at the stage of being subjected to the heat treatment simulating the hot pressing step. The JIS No. 5 tensile test specimen was then subjected to a tensile test in accordance with the JIS Z 2241 standard. Respective tensile strengths TS [MPa] of the steel sheet samples determined by the tensile test are shown in Table 2. Further, a JIS No. 5 tensile test specimen was taken from each of the test pieces of the steel sheet samples at the stage of being subjected to additional heat treatment(s) shown in Table 2 simulating heat treatment(s) after punching. The JIS No. 5 tensile test specimen was then subjected to a tensile test to measure tensile strength (TS') [MPa] thereof. In a case where the change in strength caused by heat treatment(s), i.e. ΔTS=TS−TS', is 50 MPa or less, the case is evaluated to be good and indicated by circle in Table 2. In a case where the change ΔTS exceeds 50 MPa, the case is evaluated to be poor and indicated by cross in Table 2.

Delayed Fracture Resistance

Delayed fracture resistance after shear punching was evaluated, as follows. A steel sheet which had been subjected to heat treatment simulating the hot pressing step was: perforated at its center by punching a hole with a diameter of 10 mm and clearance of 12.5%; then directly, or after being subjected to heat treatment at 50 to 300° C., immersed in 0.01% ammonium thiocyanate solution at 25° C. for hydrogen charge to investigate destruction time. Hydrogen charge was carried out through immersion in ammonium thiocyanate solution in the present invention because, as described in *CAMP-ISIJ*, Vol. 21, p. 1454: a steel sheet dissolves severely when it is immersed in hydrochloric acid, whereby edge faces thereof are significantly dissolved during the test to make it difficult to distinguish between hydrogen cracking and cracking caused by the dissolution of the steel sheet; whereas an amount of the steel sheet dissolution is extremely small when the steel sheet is immersed in ammonium thiocyanate solution, whereby it is possible to charge hydrogen equivalent to 0.1N hydrochloric acid, which allows for more precise investigation of hydrogen cracking at the sheared edges. The evaluation results are shown in Table 2, in which a case where no fracture occurred after immersion in 0.01% ammonium thiocyanate solution for 48 hours was evaluated to be good delayed fracture resistance (absence of delayed fracture) or "○", while a case were any fracture occurred was evaluated to be poor delayed fracture resistance (presence of delayed fracture) or "x".

It is assumed that an amount of hydrogen penetrating a punched edge portion is relatively large locally at the portion due to a strain introduced by punching. However, it is difficult to quantitatively evaluate the amount of hydrogen locally. Therefore, a test specimen of a steel sheet, having 20% rolling strain introduced thereto to simulate strain introduced by punching and not subjected to the first heat treatment and optionally the second heat treatment and another test specimen of the steel sheet, having the same rolling strain as described above and subjected to the first heat treatment and optionally the second heat treatment, were prepared, respectively. These two types of test specimens were immersed in 0.01% ammonium thiocyanate solution under the same conditions as the punched material. Then, an amount of diffusive hydrogen in the steel after immersion for 48 hours was analyzed by thermal desorption analysis (at temperature increasing rate of 200° C./h) to determine the amount of penetrating hydrogen. The results thereof are also shown in Table 2. An "amount of diffusive hydrogen" represents an amount of hydrogen released at 200° C. or less.

TABLE 1

(mass %)

| Steel | Chemical Compositions | | | | | | | | |
|---|---|---|---|---|---|---|---|---|---|
| sample ID | C | Si | Mn | P | S | Al | N | Ti | B |
| 1-A | 0.13 | 1.5 | 2.2 | 0.011 | 0.0014 | 0.032 | 0.0026 | — | — |
| 1-B | 0.19 | 0.5 | 1.5 | 0.010 | 0.0015 | 0.031 | 0.0032 | 0.02 | 0.0015 |
| 1-C | 0.30 | 1.0 | 1.5 | 0.012 | 0.0012 | 0.035 | 0.0028 | 0.02 | 0.0018 |

TABLE 2

| | | Tensile | 1st Heat Treatment | | 2nd Heat Treatment | | | Amount of | | |
|---|---|---|---|---|---|---|---|---|---|---|
| No. | Steel sample ID | Strength TS (Mpa) | 2nd Heating Temperature (° C.) | Retention Time (min) | 3rd Heating Temperature (° C.) | Retention Time (min) | ΔTS (Mpa) | Penetrating Hydrogen (wt ppm) | Delayed Fracture Resistance | Note |
| 1-1 | 1-A | 1420 | — | — | — | — | — | 0.72 | X | Comparative Example |
| 1-2 | | | 50 | 60 | — | — | ○ | 0.68 | X | Comparative Example |

TABLE 2-continued

| No. | Steel sample ID | Tensile Strength TS (Mpa) | 1st Heat Treatment 2nd Heating Temperature (° C.) | 1st Heat Treatment Retention Time (min) | 2nd Heat Treatment 3rd Heating Temperature (° C.) | 2nd Heat Treatment Retention Time (min) | ΔTS (Mpa) | Amount of Penetrating Hydrogen (wt ppm) | Delayed Fracture Resistance | Note |
|---|---|---|---|---|---|---|---|---|---|---|
| 1-3 | | | 100 | 60 | — | — | ○ | 0.39 | ○ | Example of Invention |
| 1-4 | | | 150 | 30 | — | — | ○ | 0.25 | ○ | Example of Invention |
| 1-5 | | | 150 | 10 | — | — | ○ | 0.39 | ○ | Example of Invention |
| 1-6 | | | 200 | 10 | — | — | ○ | 0.12 | ○ | Example of Invention |
| 1-7 | | | 250 | 1 | — | — | ○ | 0.02 | ○ | Example of Invention |
| 1-8 | | | 290 | 1 | — | — | ○ (45) | 0 | ○ | Example of Invention |
| 1-9 | | | 300 | 1 | — | — | X (60) | 0 | ○ | Comparative Example |
| 1-10 | | | 150 | 30 | 150 | 1 | ○ | 0.08 | ○ | Example of Invention |
| 1-11 | | | 100 | 60 | 200 | 1 | ○ | 0.05 | ○ | Example of Invention |
| 1-12 | | | 150 | 30 | 200 | 1 | ○ | 0.02 | ○ | Example of Invention |
| 1-13 | | | 150 | 30 | 250 | 0.5 | ○ | 0 | ○ | Example of Invention |
| 1-14 | 1-B | 1550 | — | — | — | — | — | 0.65 | X | Comparative Example |
| 1-15 | | | 200 | 10 | — | — | ○ | 0.07 | ○ | Example of Invention |
| 1-16 | | | 150 | 30 | 200 | 1 | ○ | 0.03 | ○ | Example of Invention |
| 1-17 | | | 150 | 30 | 250 | 0.5 | ○ | 0 | ○ | Example of Invention |
| 1-18 | 1-C | 1820 | — | — | — | — | — | 0.67 | X | Comparative Example |
| 1-19 | | | 200 | 10 | — | — | ○ | 0.08 | ○ | Example of Invention |
| 1-20 | | | 150 | 30 | 200 | 1 | ○ | 0.03 | ○ | Example of Invention |
| 1-21 | | | 150 | 30 | 250 | 0.5 | ○ | 0.01 | ○ | Example of Invention |

It was found from Table 2 that our examples that were subjected to heat treatment after forming, i.e. Example Nos. 1-3 to 1-8, 1-10 to 1-13, 1-15 to 1-17 and 1-19 to 1-21 unanimously exhibited a relatively small amount of penetrating hydrogen after immersion in an ammonium thiocyanate solution, showed no delayed fracture and were excellent in delayed fracture resistance.

In contrast, Comparative Examples which were not subjected to heat treatment after punching or subjected to heat treatment at relatively to temperatures, i.e. Comp. Example Nos. 1-1, 1-2, 1-14 and 1-18, all showed fracture during an immersion test in ammonium thiocyanate solution for 48 hours. Further, Comparative Example No. 1-9, which was subjected to heat treatment at a temperature exceeding the upper limit of the present invention, exhibited decrease in strength exceeding 50 MPa after the heat treatment, although Comp. Example No. 1-9 showed no delayed fracture and was excellent in delayed fracture resistance.

It was confirmed that Example Nos. 1-10, 1-11, 1-12, 1-13, 1-16, 1-17, 1-20 and 1-21 which were subjected to reheating after the heat treatment, among our examples, each exhibited an extremely small amount of penetrating hydrogen due to the two-cycle heat treatment and were more excellent in delayed fracture resistance than other Examples.

Experiment 2

Steel slab samples having the chemical compositions shown in Table 3 were manufactured by continuous casting, reheated to 1250° C. and then hot rolled at a finish rolling temperature of about 850° C. to hot rolled steel sheet samples each having thickness of 3.0 ram. Each of the hot rolled sheet samples was subjected to coiling at coiling temperature of about 600° C., pickling, and cold rolling to be finished to a cold rolled steel sheet having a sheet thickness of 1.6 mm. Then, the cold rolled steel sheet was heated and soaked at 800° C. for 300 seconds, cooled to 400° C. at the average cooling rate of 5° C./sec, and then subjected to overaging treatment at 400° C. for 10 minutes. Subsequently, the steel sheet was subjected to temper rolling at an elongation rate of 0.2%.

Each of the steel sheet samples thus obtained were cut to a test piece having dimension of 50 mm W×200 mm L such that the longitudinal axis of the piece was perpendicular to the rolling direction. The test piece was heated to 900° C., collected after 3 minutes and then immediately cooled by bringing upper and lower steel dies into close contact with the test pieces, which simulated cooling of a steel sheet at the hot press forming step. The cooling rate at this stage was about 50° C./sec and the finish cooling temperature was 100° C. or less.

The resulting test piece were further subjected to the corresponding heat treatment(s) shown in Table 4 and analyzed for tensile strength TS and delayed fracture resistance thereof. The details of each test method are as follows.

Tensile Strength TS

A JIS No. 5 tensile test specimen was taken from each of the test pieces of the steel sheet samples at the stage of being subjected to the heat treatment simulating the hot pressing step. The JIS No. 5 tensile test specimen was then subjected to a tensile test in accordance with the JIS Z 2241 standard. Respective tensile strengths TS [MPa] of the steel sheet samples determined the tensile test are shown in Table 4. Further, a JIS No. 5 tensile test specimen was taken from each of the test pieces of the steel sheet samples at the stage of being subjected to additional heat treatment(s) shown in Table 4 simulating heat treatment(s) after punching. The JIS No. 5 tensile test specimen was then subjected to a tensile test to measure tensile strength (TS') [MPa] thereof. In a case where the change in strength caused by heat treatment(s), i.e. $\Delta TS=TS-TS'$, is 50 MPa or less, the case is evaluated to be good and indicated by circle m Table 4. In a case where the change $\Delta TS$ exceeds 50 MPa, the case is evaluated to be poor and indicated by cross in Table 4.

Delayed Fracture Resistance

Delayed fracture resistance after shear punching was evaluated as follows: a steel sheet which had been subjected to heat treatment simulating the hot pressing step was perforated at its center by punching, a hole with a diameter of 10 mm at a clearance of 12.5%, and then directly, or after being subjected to heat treatment at 50 to 300° C., subjected to chemical conversion treatment and electrodeposition coating under the conditions shown below. The evaluation results are shown in Table 4, in which a case where no fracture occurred during the chemical conversion treatment and electrodeposition coating was evaluated to be good delayed fracture resistance (absence of delayed fracture) or "○", while a case where any fracture occurred was evaluated to be poor delayed fracture resistance (presence of delayed fracture) or "x".

It is assumed that an amount of hydrogen penetrating a punched edge portion is relatively large locally at the portion due to a strain introduced by punching. However, it is difficult to quantitatively evaluate the amount of hydrogen locally. Therefore, in the present invention, a test specimen of a steel sheet, having 20% rolling strain introduced thereto to simulate strain introduced by punching. The test specimen was further subjected to heat treatment, chemical conversion treatment and electrodeposition coating under the same conditions as the above-described punched members. Then, an amount of diffusive hydrogen in the steel was analyzed by programmed temperature gas chromatography at temperature increasing rate of 200° C./h) to determine the amount of penetrating hydrogen. The results thereof are also shown in Table 4. An "amount of diffusive hydrogen" represents an amount of hydrogen released at 200° C. or less.

Chemical Conversion Treatment Conditions

Chemical conversion treatment was conducted using a commercially available chemical conversion treatment agent (Palbond P13-L3020, manufactured by Nihon Parkerizing Co., Ltd.) at bath temperature of 43'C for a processing time of 120 seconds.

Electrodeposition Coating Conditions

The steel sheet thus treated by chemical conversion was subjected to electrodeposition coating using a commercially available electrodeposition coating material (GT-10HT, manufactured by Kansai Paint Co., Ltd.) so that the resulting steel sheet had a coating thickness of 20 to 25 μm.

TABLE 3

(mass %)

| Steel | Chemical Compositions | | | | | | | | |
|---|---|---|---|---|---|---|---|---|---|
| sample ID | C | Si | Mn | P | S | Al | N | Ti | B |
| 2-A | 0.21 | 0.5 | 2.0 | 0.010 | 0.0015 | 0.031 | 0.0032 | — | — |
| 2-B | 0.30 | 1.0 | 1.5 | 0.012 | 0.0012 | 0.035 | 0.0028 | 0.02 | 0.0018 |

TABLE 4

| No. | Steel sample ID | Tensile Strength TS (Mpa) | 1st Heat Treatment: 2nd Heating Temperature (° C.) | 1st Heat Treatment: Retention Time (min) | ΔTS (Mpa) | Amount of Penetrating Hydrogen (wt ppm) | Delayed Fracture Resistance | Note |
|---|---|---|---|---|---|---|---|---|
| 2-1 | 2-A | 1580 | — | — | — | 0.25 | X | Comparative Example |
| 2-2 | | | 50 | 60 | ○ | 0.21 | X | Comparative Example |
| 2-3 | | | 100 | 60 | ○ | 0.13 | ○ | Example of Invention |
| 2-4 | | | 150 | 30 | ○ | 0.08 | ○ | Example of Invention |
| 2-5 | | | 150 | 10 | ○ | 0.10 | ○ | Example of Invention |
| 2-6 | | | 200 | 10 | ○ | 0.03 | ○ | Example of Invention |
| 2-7 | | | 250 | 1 | ○ | 0.01 | ○ | Example of Invention |
| 2-8 | | | 290 | 1 | ○ (45) | 0 | ○ | Example of Invention |
| 2-9 | | | 300 | 1 | X (65) | 0 | ○ | Comparative Example |
| 2-10 | 2-B | 1830 | — | — | — | 0.27 | X | Comparative Example |

TABLE 4-continued

| No. | Steel sample ID | Tensile Strength TS (Mpa) | 1st Heat Treatment 2nd Heating Temperature (° C.) | Retention Time (min) | ΔTS (Mpa) | Amount of Penetrating Hydrogen (wt ppm) | Delayed Fracture Resistance | Note |
|---|---|---|---|---|---|---|---|---|
| 2-11 | | | 200 | 10 | ○ | 0.03 | ○ | Example of Invention |

It was found from Table 4 that our Examples that were subjected to heat treatment after forming, i.e. Example Nos. 2-3 to 2-8 and 2-11 unanimously exhibited a relatively small amount of penetrating hydrogen caused by chemical conversion treatment and electrodeposition coating, showed no delayed fracture and were excellent in delayed fracture resistance.

In contrast, Comparative Examples which were not subjected to heat treatment after punching or subjected to heat treatment at relatively low temperatures, i.e. Example Nos. 2-1, 2-2 and 2-10 all showed fracture during the conversion treatment and electrodeposition coating. Further, Comparative Example No. 2-9, which was subjected to heat treatment at a temperature exceeding our upper limit, exhibited decrease in strength exceeding 50 MPa after the heat treatment, although Comp, Example No. 2-9 showed no delayed fracture and was excellent in delayed fracture resistance.

The invention claimed is:

1. A method for manufacturing an ultra high strength member comprising:

heating a steel sheet at a first heating temperature within a temperature range of 700 to 1000° C.;

forming the steel sheet into a shape of a member at the first heating temperature and simultaneously cooling the steel sheet;

after completion of the cooling, shear punching the steel sheet into a desired shape to obtain an ultra high strength member;

after the shear punching, subjecting the ultra high strength member to a first heat treatment including heating the ultra high strength member at a second heating temperature within a temperature range of 100° C. or higher and 150° C. or lower, and retaining the member at the second heating temperature for 1 second to 60 minutes;

after the first heat treatment, cooling the ultra high strength member; and after the cooling, subjecting the ultra high strength member to a second heat treatment including reheating the ultra high strength member at a third heating temperature within a temperature range of 150° C. or higher, but lower than 300° C. and retaining the member at the third heating temperature for 1 second to 10 minutes, wherein the resulting ultra high strength member has a tensile strength of 1180 MPa or more.

2. The method according to claim 1, wherein the first heat treatment is carried out such that the retention time at the second heating temperature is 10 minutes or less.

* * * * *